US011589438B2

(12) United States Patent
Lee et al.

(10) Patent No.: US 11,589,438 B2
(45) Date of Patent: Feb. 21, 2023

(54) METHOD OF CONTROLLING WARNING LIGHTS TO ENTER LOW POWER MODE

(71) Applicant: ESUSE AUTO PARTS MANUFACTURING CO., LTD., New Taipei (TW)

(72) Inventors: Ting-Fang Lee, New Taipei (TW); Wen-Chung Han, New Taipei (TW)

(73) Assignee: ESUSE AUTO PARTS MANUFACTURING CO., LTD., New Taipei (TW)

( * ) Notice: Subject to any disclaimer, the term of this patent is extended or adjusted under 35 U.S.C. 154(b) by 0 days.

(21) Appl. No.: 17/486,081

(22) Filed: Sep. 27, 2021

(65) Prior Publication Data

US 2022/0272808 A1 Aug. 25, 2022

Related U.S. Application Data

(63) Continuation-in-part of application No. 17/345,765, filed on Jun. 11, 2021, now Pat. No. 11,452,191.

(30) Foreign Application Priority Data

Feb. 25, 2021 (TW) ..... 110106770

(51) Int. Cl.
*H05B 45/10* (2020.01)
*H05B 45/347* (2020.01)

(52) U.S. Cl.
CPC ..... *H05B 45/347* (2020.01); *H05B 45/10* (2020.01)

(58) Field of Classification Search
CPC ..... H05B 45/10; H05B 45/347; H05B 47/10; H05B 47/16; H05B 47/155; H05B 47/165
See application file for complete search history.

(56) References Cited

U.S. PATENT DOCUMENTS

2014/0239807 A1* 8/2014 Hammock ..... B60Q 1/445 315/77
2020/0029642 A1* 1/2020 Kinney ..... B62J 6/045

* cited by examiner

*Primary Examiner* — Jimmy T Vu
(74) *Attorney, Agent, or Firm* — Muncy, Geissler, Olds & Lowe, P.C.

(57) ABSTRACT

Method of controlling warning lights to enter low power mode includes steps of: setting predetermined ID Number of warning lights as starter, and remaining ID numbers as receivers; warning light set as starter receiving start command from control bus through signal line, and sending data, clock pulse, and ID information from data bus, and choosing low power mode to flash; warning lights set as receivers obtaining data, clock pulse, and ID information from data bus through signal lines, and flash mode of receivers and starter flashing in low power mode, and active switch of control circuit that executes low power mode receiving low power command sent from starter and forming conductive state, and current-reducing resistor which is electrically connected to active switch reducing passing current to predetermined ratio, so that reduced current is transmitted to receivers and then starter executes low power mode and reduces brightness of warning lights.

9 Claims, 8 Drawing Sheets

METHOD OF CONTROLLING WARNING LIGHTS TO ENTER LOW POWER MODE

This application is a Continuation-In-Part of application Ser. No. 17/345,765, filed on Jun. 11, 2021, for which priority is claimed under 35 U.S.C. § 120, the entire contents of which are hereby incorporated by reference.

This application claims the priority benefit of Taiwan patent application number 110106770, filed on Feb. 25, 2021.

BACKGROUND OF THE INVENTION

1. Field of the Invention

The present invention relates to warning light control technology, and more particularly to a method of controlling warning lights to enter low power mode. Through the control circuit, the current flowing into the multiple warning lights is limited, so that the multiple warning lights enter the low power mode and their lumens are lowered to match the vehicle equipped with the multiple warning lights at night when the brightness is moderate and not dazzling. At the same time, it can extend the service life of the warning lights and its power supply module.

2. Description of the Related Art

Warning lights are used in many environments and places, such as road construction warnings, public places safety warnings, high-rise building safety warnings, fire trucks, ambulances and police vehicles, etc. Warning lights can be divided into a single warning light or a light device composed of multiple warning lights, and the light device is mostly installed on the roof of the aforementioned vehicle that needs to be warned. When the conventional light device executes the flashing of multiple warning lights, an electronic control device must first control the multiple warning lights. However, the use environment of warning lights includes: day, night, rain, snow, fog, etc., and the brightness of the warning lights required by different situations is different. For example: the brightness of the warning light at night only needs 70% of the brightness during the day, so that passers-by can clearly recognize the flashing state of the warning light and achieve a warning effect. Others, such as daytime, rain, snow, and fog, require 100% brightness. However, the conventional warning lights do not have any mechanism to reduce the brightness, so they cannot save the power of the vehicle's power supply module, and the full-time supply of 100% power to light the warning lights may shorten the service life of the warning lights and the power supply module. The aforementioned shortcomings of the light devices sold in the market need to be improved by those engaged in this industry.

SUMMARY OF THE INVENTION

The present invention has been accomplished under the circumstances in view. It is therefore the main object of the present invention to provide a method of controlling warning lights to enter low power mode, which comprises the following steps: Set a predetermined ID Number of these Warning Lights as a Starter, and the remaining ID Numbers as Receivers; the Warning Light set as Starter receives the Start Command from the Control Bus through its signal line, and sends a Data, a Clock Pulse and an ID Information from the Data Bus, and choose a Low Power mode to flash; the Warning Lights set to Receivers obtain the Data, the Clock Pulse, and the ID Information from the Data Bus through their signal lines, and the Flash Mode of the Receivers and the Starter flashes in the Low Power mode, and the control circuit that executes the Low Power mode comprises an Active Switch, and the Active Switch receives the Low Power command sent from the Starter and forms a conductive state, and a Current-reducing Resistor, which is electrically connected to the Active Switch, reduces the passing current to a predetermined ratio, and the reduced current is transmitted to the plurality of Receivers and then the Starter executes the Low Power mode and reduces the brightness of the Warning Lights. Using the control circuit to limit the current flowing into the multiple Warning Lights so that the multiple Warning Lights enter the Low Power mode and reduce their lumens to match the vehicle with the multiple Warning Lights, and thus, the brightness is moderate and not dazzling when performing duties at night, and it also extends the service life of Warning Lights and its power supply modules.

It is another object of the present invention to provide a method of controlling warning lights to enter low power mode, wherein the control circuit is equipped with two Voltage Divider Resistors on its input side, and one of the Voltage Divider Resistors is connected in parallel with a Zener Diode that can stabilize, and the Zener Diode is connected in parallel with the Active Switch. The Active Switch is connected in series with the Current-reducing Resistor, and the Current-reducing Resistor is electrically connected to a pin with a current adjustment function of an LED Control IC. Two pins of the LED Control IC are electrically connected with an inductor, a Schottky diode with a low turn-on voltage, a resistor, and an input voltage. Two pins of the LED Control IC are connected to the ground side with complex bypass capacitors that can reduce noise. And the sensing pin of the LED Control IC is electrically connected to the Light Device. The Light Device includes the Warning Lights to form a control circuit that can execute the Low Power mode.

It is still another object of the present invention to provide a method of controlling warning lights to enter low power mode, wherein the Current-reducing Resistor reduces the passing current to a predetermined ratio ranges from 50%~80% of the maximum current value.

It is still another object of the present invention to provide a method of controlling warning lights to enter low power mode, wherein the Flash Mode comprises the modes of synchronous, interlace, polling, recursive and low power.

It is still another object of the present invention to provide a method of controlling warning lights to enter low power mode, wherein before selecting the Low Power mode from the Flash Mode to flash the light, the warning light set as the Starter performs an EEPROM data initialization.

It is still another object of the present invention to provide a method of controlling warning lights to enter low power mode, wherein before the warning lights set as Receivers receive any signal from the control bus and the data bus through the signal lines thereof, the warning lights set as Receivers flash according to the Flash Mode stored in an EEPROM.

It is still another object of the present invention to provide a method of controlling warning lights to enter low power mode, wherein before the Starter and the Receivers change their identities, the Receivers suspend the current Flash Mode and then execute a Self-flash Mode.

DETAILED DESCRIPTION OF THE PREFERRED EMBODIMENT

Figure 1:
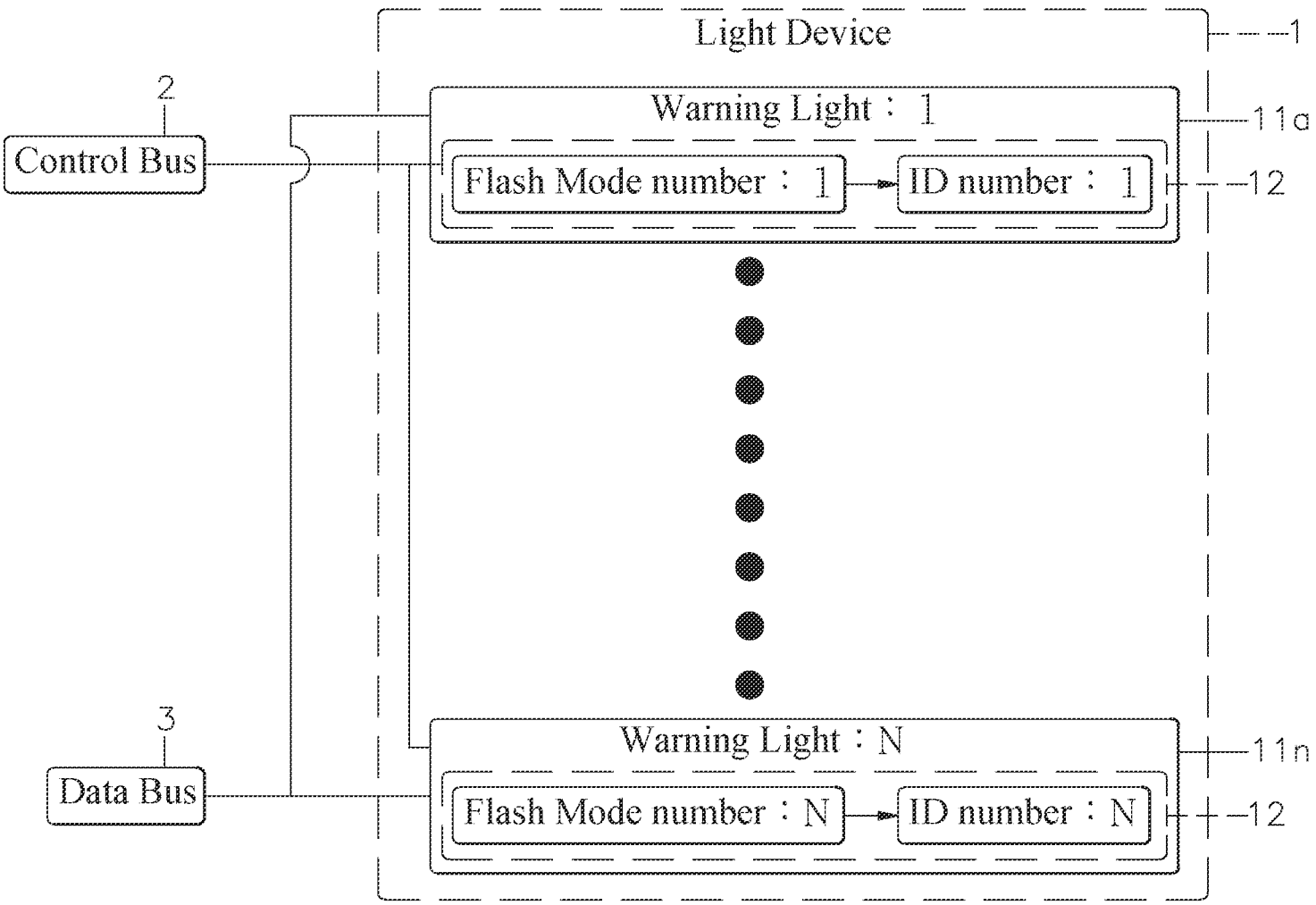
FIG. 1 is a functional block diagram of the Light Device and its control architecture according to the present invention.
Figure 2:
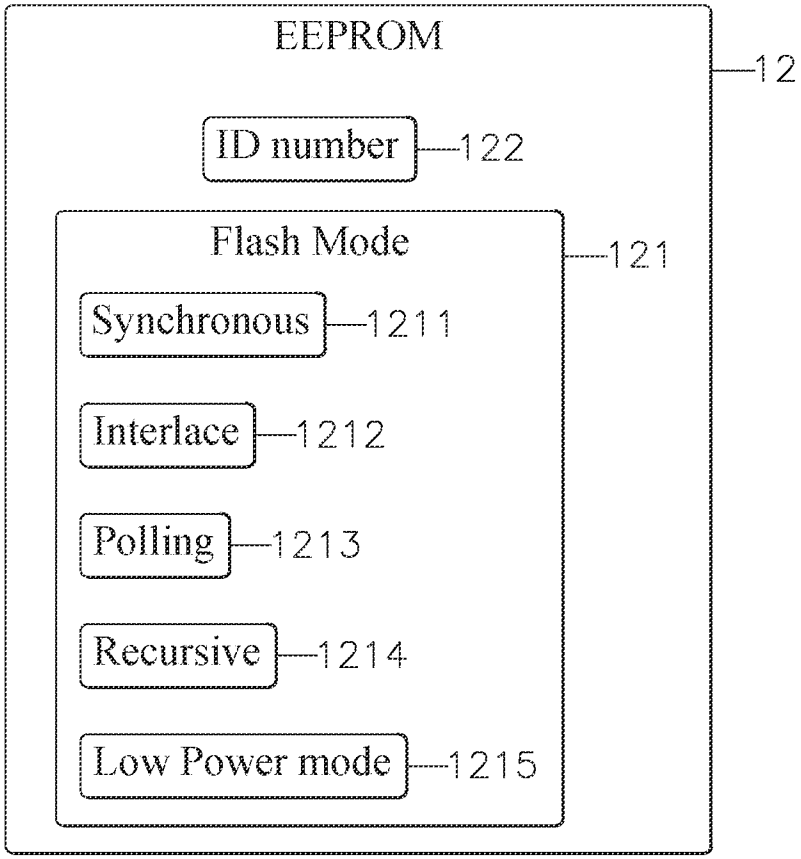
FIG. 2 is a functional block diagram of the data stored in the EEPROM of the present invention.
Figure 3:
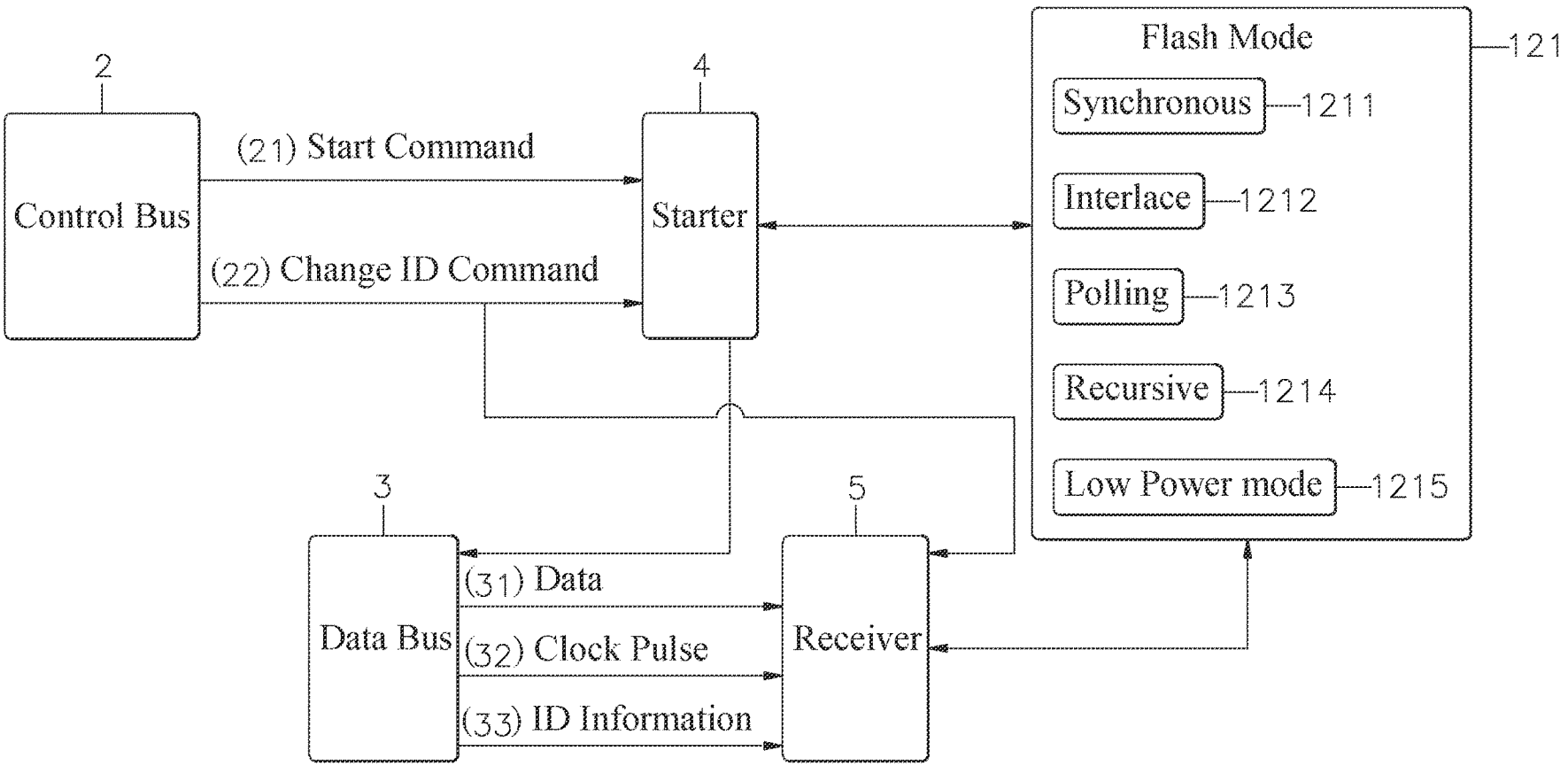
FIG. 3 is another functional block diagram of the Light Device and its control architecture according to the present invention.
Figure 5:
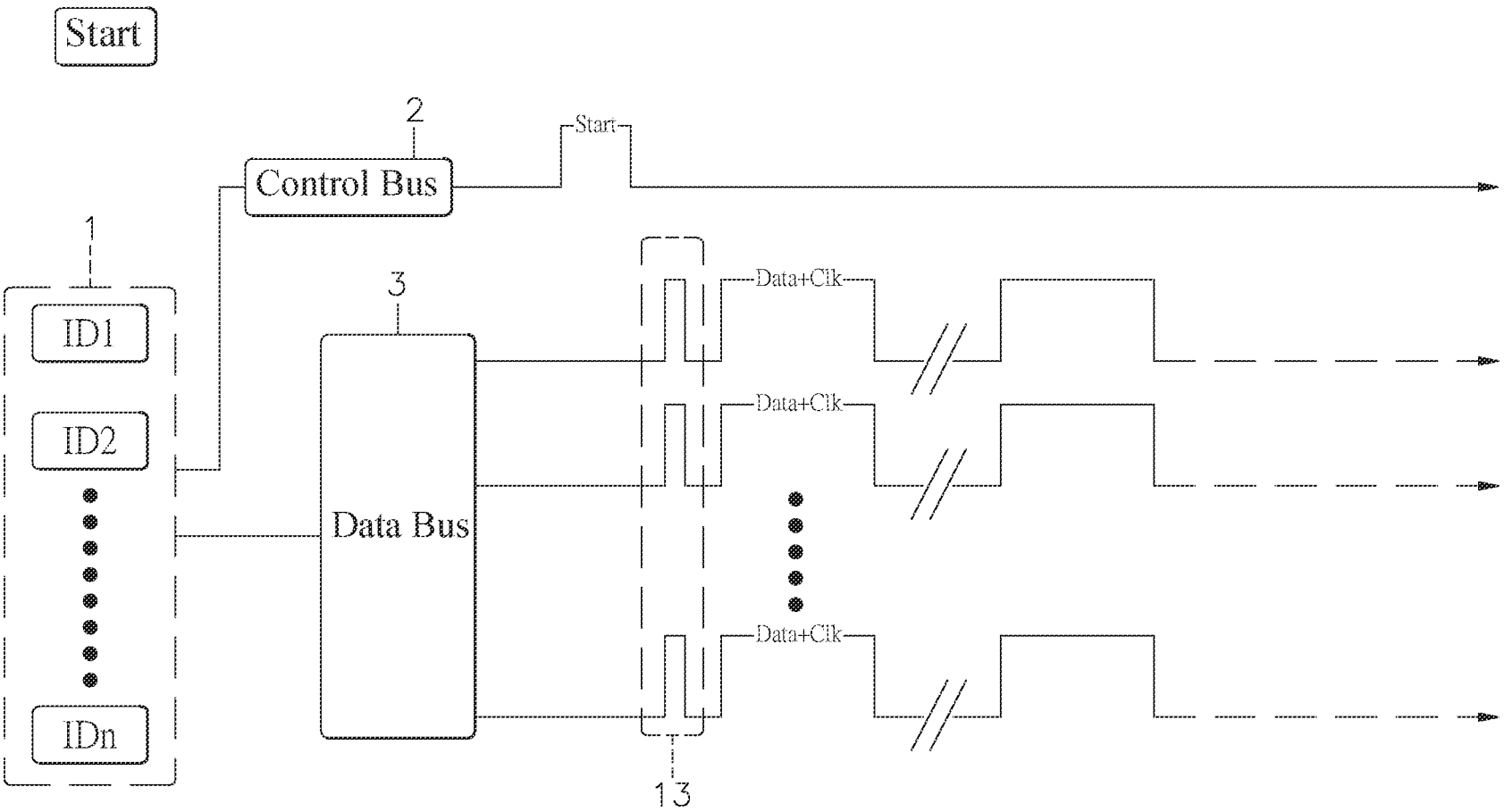
FIG. 5 is a pulse signal diagram of the Warning Lights of the Starter and Receivers of the present invention in the start mode.
Figure 6:
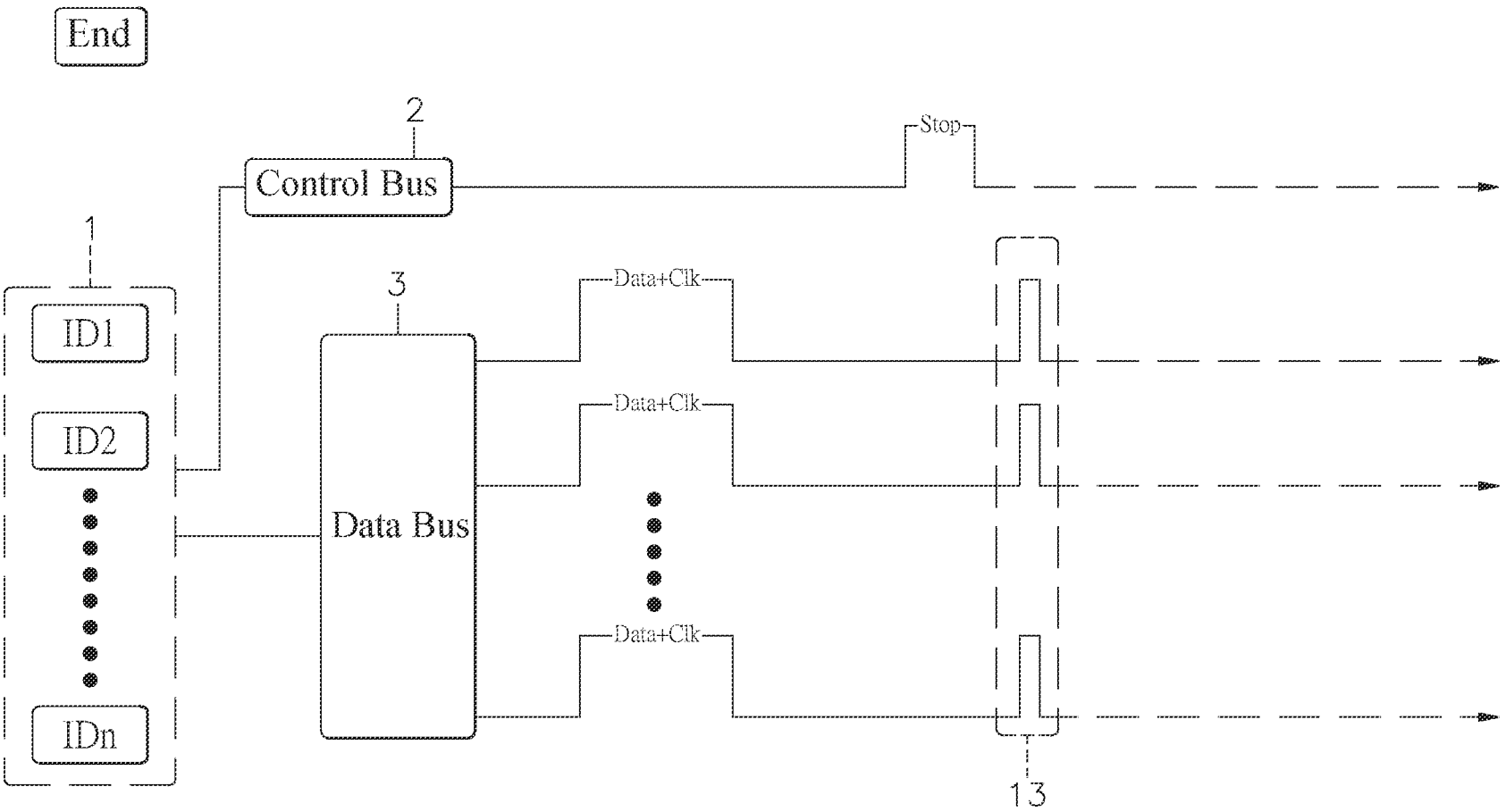
FIG. 6 is a pulse signal diagram of the Warning Lights of the Starter and Receivers of the present invention in the end mode.

Referring to FIGS. 1-3 and 5-6, where FIG. 1 is a functional block diagram of the Light Device and its control architecture according to the present invention; FIG. 2 is a functional block diagram of the data stored in the EEPROM of the present invention; FIG. 3 is another functional block diagram of the Light Device and its control architecture according to the present invention; FIG. 5 is a pulse signal diagram of the Warning Lights of the Starter and Receivers of the present invention in the start mode; FIG. 6 is a pulse signal diagram of the Warning Lights of the Starter and Receivers of the present invention in the end mode. The Light Device control architecture of the present invention comprises a Light Device 1, a Control Bus 2 and a Data Bus 3. Its main components and features are detailed as follows:

Referring to FIG. 1, the Light Device 1 comprises a plurality of Warning Lights (11*a*~11*n*), and each of these Warning Lights (11*a*~11*n*) is electrically connected to the Control Bus 2 and the Data Bus 3 through a cable. The Warning Lights (11*a*~11*n*) each comprises a circuit board (PCB) (not shown), and a plurality of light emitting diodes (LEDs) (not shown), at least one EEPROM 12 and multiple metal pads for electrical connection of multiple cables (not shown) are arranged on the circuit board.

Figure 7:
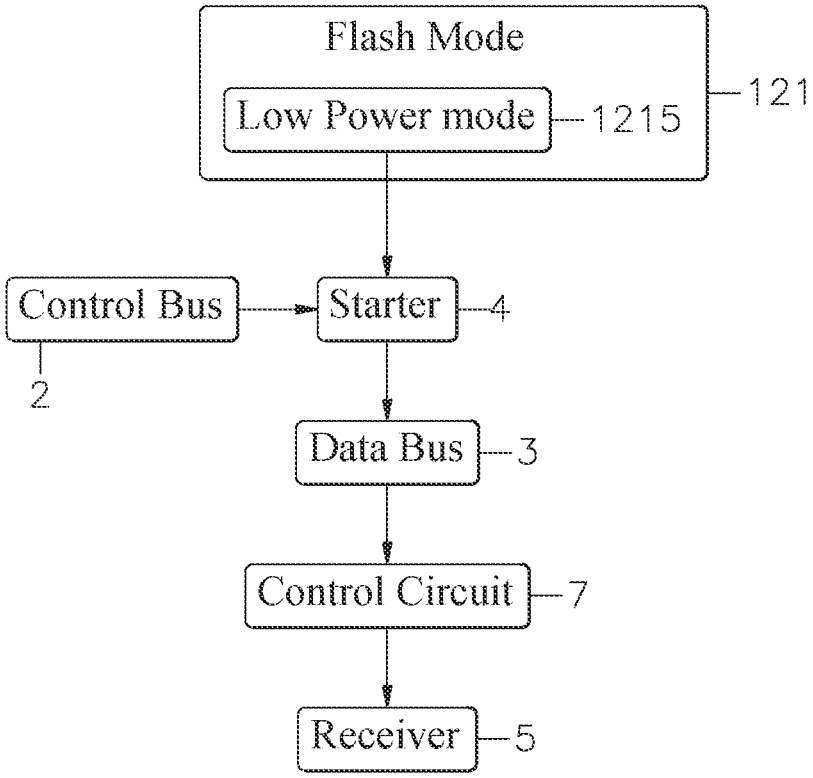
FIG. 7 is a functional block diagram of the present invention to execute the Low Power mode.
Figure 8:
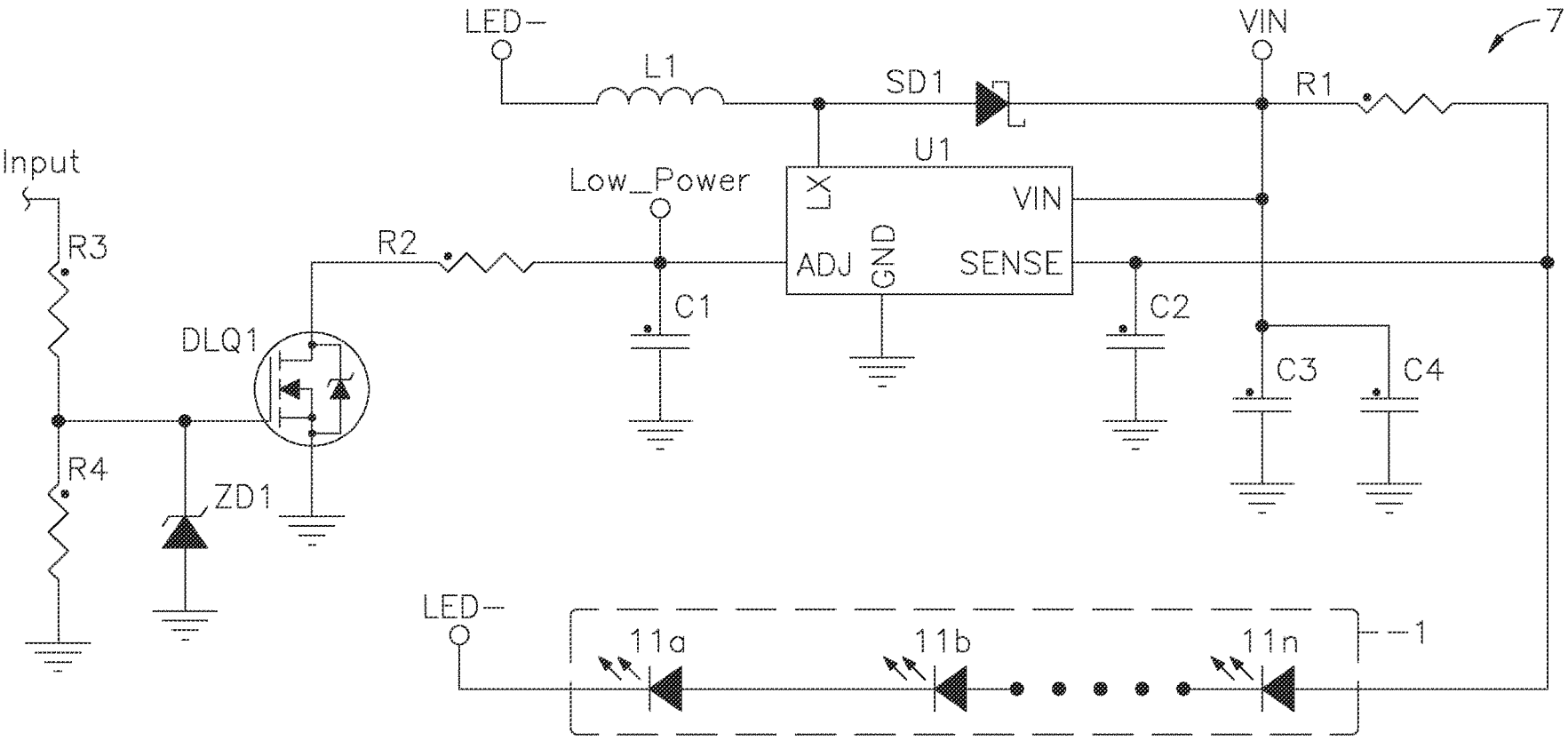
FIG. 8 is a control circuit diagram of the Low Power mode of the present invention.

Referring to FIGS. 2, 7 and 8, the EEPROM 12 of each of the Warning Lights (11*a*~11*n*) has stored therein a Flash Mode 121 and an ID Number 122. The Flash Mode 121 includes the modes of Synchronous 1211, Interlace 1212, Polling 1213, Recursive 1214 and Low Power 1215. In addition to the aforementioned Flash Mode 121, a Starter 4 can also use the Data Bus 3 to control a plurality of Receivers 5 to flash in different modes (for example: the first Receiver is to do Synchronous, the second Receiver is to do Polling, and the third Receiver is to do Interlace).

The aforementioned control of the flashing of the multiple Receivers 5 by the Starter 4 is also within the protection scope of the present invention. The ID Number 122 is determined by a Start Command 21 of the Control Bus 2 and a Change ID Command 22. Therefore, the ID Numbers 122 of the Warning Lights (11*a*~11*n*) are in a floating state, but they can only be changed when the above two signals (21, 22) are received. A control circuit 7 that executes the Low Power 1215 comprises an Active Switch DLQ1. The Active Switch DLQ1 receives the Low Power 1215 command sent from the Starter 4 and forms a conductive state. Electrically connected to the Active Switch DLQ1, a Current-reducing Resistor R2 (predetermined resistance value obtained through calculation) reduces the passing current to a predetermined ratio (the predetermined ratio ranges from 50% to 80% of the maximum current value). After the reduction, the current is transmitted to the plurality of Receivers 5 and followed by the Starter 4 to execute the Low Power 1215 and reduce the brightness of the Warning Lights (11*a*~11*n*). Those who are familiar with this technique can also use Pulse-Width Modulation (PWM) software control method to execute the Low Power 1215. The method of using software to perform Pulse-Width Modulation is a conventional technology, so it will not be repeated here. But this method of implementing the Low Power 1215 should be covered by the present invention.

Please refer to FIG. 8. The control circuit 7 is equipped with two Voltage Divider Resistors (R3, R4) on its input side, and one of the Voltage Divider Resistors R4 is connected in parallel with a Zener Diode ZD1 that can stabilize, and the Zener Diode ZD1 is connected in parallel with the Active Switch DLQ1. The Active Switch DLQ1 is connected in series with the Current-reducing Resistor R2, and the Current-reducing Resistor R2 is electrically connected to a pin (ADJ) with a current adjustment function of an LED Control IC U1. Two pins (LX, VIN) of the LED Control IC U1 are electrically connected with an inductor L1, a Schottky diode SD1 with a low turn-on voltage, a resistor R1, and an input voltage VIN. Two pins (ADJ, SENSE) of the LED Control IC U1 are connected to the ground side with complex bypass capacitors (C1, C2, C3, C4) that can reduce noise. And the sensing pin (SENSE) of the LED Control IC U1 is electrically connected to the Light Device 1. The Light Device 1 includes the Warning Lights (11*a*~11*n*) to form a control circuit 7 that can execute the Low Power 1215.

Referring to FIG. 3, the Control Bus 2 sends the Start Command 21 to notify the multiple Warning Lights (11*a*~11*n*), set the Flash Mode 121 and sequentially number each Warning Light (11*a*~11*n*) by starting from 1, and use the Flash Mode 121 number to synchronously set the ID Number 122 of each Warning Light (11*a*~11*n*). Set a predetermined ID Number of these Warning Lights (11*a*~11*n*) as the Starter 4, and the rest of the ID Numbers as Receivers 5. The Warning Light set as Starter 4 receives the Start Command 21 from the Control Bus 2 through its signal line, and sends a Data 31, a Clock Pulse 32 and an ID Information 33 from the Data Bus 3. Choose one of them (Synchronous 1211, Interlace 1212, Polling 1213, Recursive 1214, or Low Power 1215) by the Flash Mode 121 to flash the lights. From the Warning Lights set to Receiver 5 through their signal lines, the Data 31, the Clock Pulse 32 and the ID Information 33 are obtained from the Data Bus 3. The Receivers 5 and the Flash Mode 121 of the Starter 4 flash in synchronization, non-synchronization, or Low Power 1215. Before these Receivers 5 execute the light flashing, execute a Self-flash Mode 13 (as shown in FIG. 5).

The above multiple Warning Lights (11*a*~11*n*) are synchronized to set the ID Number 122 of each Warning Light (11*a*~11*n*) through the Flash Mode 121 number. Generally speaking, the one that can set the ID Number to 1 is the Starter 4. But the present invention is not self-limiting. Each ID Number can be set as Starter 4 through the Control Bus 2. For example: the ID Numbers 2, 5, 8 and other numbers other than 1 may also be used as Starter 4. The mode of setting the Warning Light (11*a*~11*n*) of any ID Number through the Control Bus 2 as Starter 4 is also protected by the present invention.

When the Starter 4 and the Receivers 5 are synchronized or not synchronized, the lights are flashing, if they receive the Change ID Command 22 sent by their common Control Bus 2, then perform the identity change of the Starter 4 and the plurality of Receivers 5. The specific method is that before the Starter 4 and the Receivers 5 change their identities, the Receivers 5 suspend the current Flash Mode 121 and then execute the Self-flash Mode 13 (as shown in FIG. 6). The Control Bus 2 will re-send the Start Command 21 to notify the multiple Warning Lights (11*a*~11*n*), set the Flash Mode 121 and number each Warning Light (11*a*~11*n*) sequentially by starting from 1, and use the Flash Mode 121 number to synchronously set the ID Number 122 of each Warning Light (11*a*~11*n*).

Figure 4:
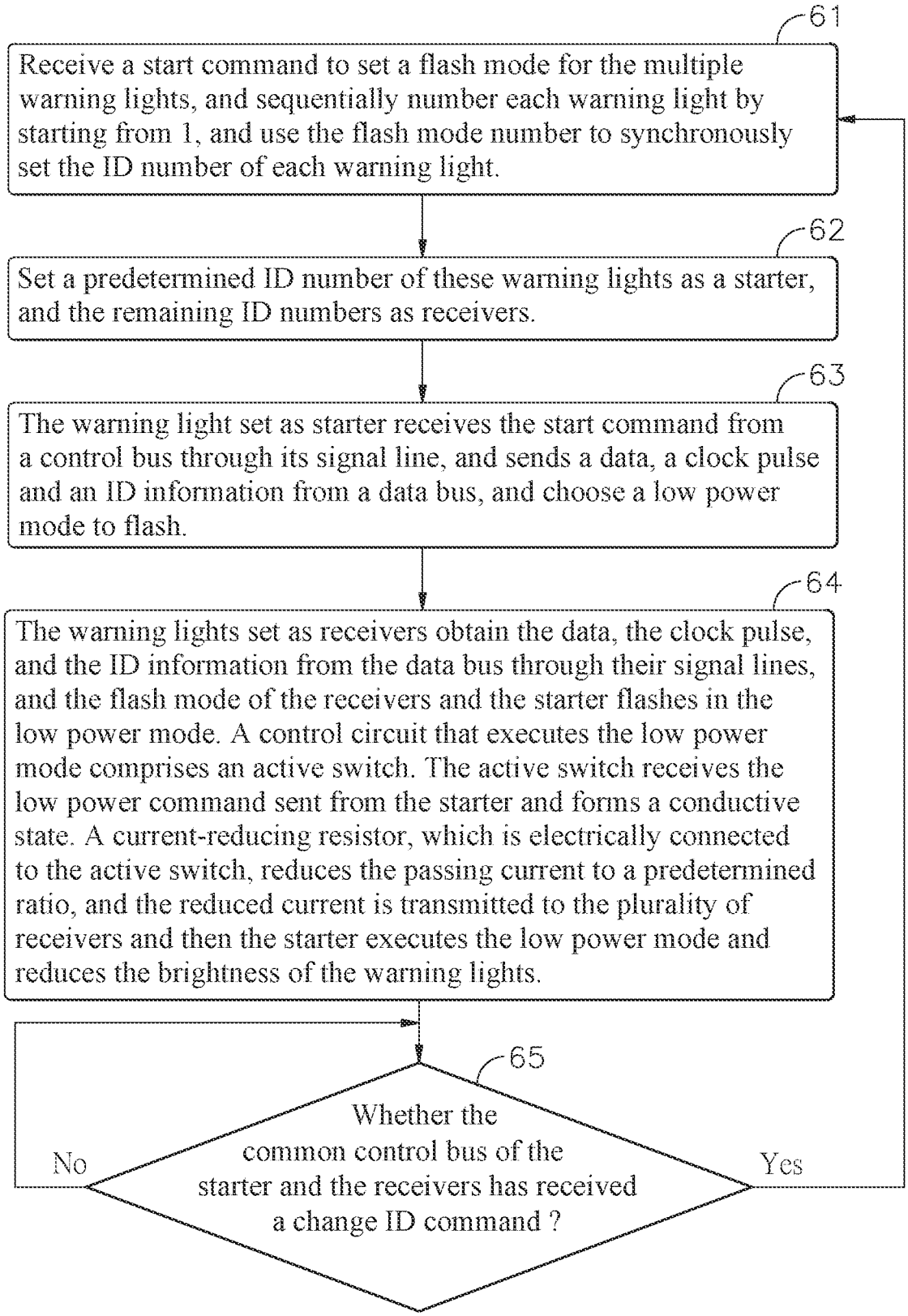
FIG. 4 is a control flow chart of the Light Device of the present invention.

Please refer to FIG. 4, which is the method of controlling warning lights to enter low power mode of the present invention, which includes the following steps:

61: Receive a Start Command to set a Flash Mode for the multiple Warning Lights, and sequentially number each Warning Light by starting from 1, and use the Flash Mode number to synchronously set the ID number of each Warning Light.

62: Set a predetermined ID Number of these Warning Lights as a Starter, and the remaining ID Numbers as Receivers.

63: The Warning Light set as Starter receives the Start Command from a Control Bus through its signal line, and sends a Data, a Clock Pulse and an ID Information from a Data Bus, and choose a Low Power mode to flash. Before selecting the Low Power mode from the Flash Mode to flash the light, the Warning Light set as the Starter performs an EEPROM data initialization.

64: The Warning Lights set as Receivers obtain the Data, the Clock Pulse, and the ID Information from the Data Bus through their signal lines, and the Flash Mode of the Receivers and the Starter flashes in the Low Power mode. A control circuit that executes the Low Power mode comprises an Active Switch. The Active Switch receives the Low Power command sent from the Starter and forms a conductive state. A Current-reducing Resistor, which is electrically connected to the Active Switch, reduces the passing current to a predetermined ratio, and the reduced current is transmitted to the plurality of Receivers and then the Starter executes the Low Power mode and reduces the brightness of the Warning Lights.

65: Whether the common Control Bus of the Starter and the Receivers has received a Change ID Command, if yes, go to step 61; if so, continue to execute the Low Power mode. Before the Starter and the Receivers change their identities, the Receivers suspend the current Flash Mode and then execute a Self-flash Mode.

According to the disclosure in FIGS. 1 to 8 above, it can be understood that the present invention is a method of controlling warning lights to enter low power mode, which comprises the following steps: Set a predetermined ID Number of these Warning Lights as a Starter, and the remaining ID Numbers as Receivers; the Warning Light set as Starter receives the Start Command from the Control Bus through its signal line, and sends a Data, a Clock Pulse and an ID Information from the Data Bus, and choose a Low Power mode to flash; the Warning Lights set to Receivers obtain the Data, the Clock Pulse, and the ID Information from the Data Bus through their signal lines, and the Flash Mode of the Receivers and the Starter flashes in the Low Power mode, and a control circuit that executes the Low Power mode comprises an Active Switch, and the Active Switch receives the Low Power command sent from the Starter and forms a conductive state, and a Current-reducing Resistor, which is electrically connected to the Active Switch, reduces the passing current to a predetermined ratio, and the reduced current is transmitted to the plurality of Receivers and then the Starter executes the Low Power mode and reduces the brightness of the Warning Lights. Using the control circuit to limit the current flowing into the multiple Warning Lights so that the multiple Warning Lights enter the Low Power mode and reduce their lumens to match the vehicle with the multiple Warning Lights, and thus, the brightness is moderate and not dazzling when performing duties at night, and it also extends the service life of Warning Lights and its power supply modules.

The present invention has excellent practicability when applied to vehicles equipped with light devices (e.g., fire trucks, ambulances, and police vehicles), so a patent application was filed to seek patent protection.

The above are only preferred embodiments of the present invention, and are not to limit the scope of the patent of the present invention. Therefore, all simple modifications and equivalent structural changes using the description and schematic content of the present invention should be included in the present invention in the same way.

In summary, the above method of controlling warning lights to enter low power mode of the present invention can indeed achieve its efficacy and purpose when used. Therefore, the present invention is truly an invention with excellent practicability and meets the requirements of an invention patent application. The application is filed in accordance with the law, and it is hoped that the review committee will grant this case as soon as possible to protect the inventor's hard work.

What the invention claimed is:

1. A method of controlling warning lights to enter low power mode comprising a plurality of warning lights of a light device, each of said warning lights being electrically connected to a control bus and a data bus through a signal line, the method, after said light device is started, comprising the steps of:

A. receiving a start command to set a flash mode for said warning lights of said light device, and sequentially numbering each said warning light by starting from 1, and using the flash mode number to synchronously set an identification (ID) number of each said warning light;

B. setting a predetermined ID number of said warning lights as a starter, and the remaining ID numbers as receivers;

C. the warning light set as starter receiving the start command from said control bus through the signal line thereof, and sending a data, a clock pulse and an ID information from said data bus, and choosing a low power mode to flash;

D. the said warning lights set to receivers obtaining said data, said clock pulse, and said ID information from said data bus through the signal lines thereof, and said flash mode of said receivers and said starter flashing in said low power mode, a control circuit that executes said low power mode comprising an active switch, said active switch receiving the low power command sent from said starter and forming a conductive state, a current-reducing resistor, which is electrically connected to said active switch, reducing the passing current to a predetermined ratio, and the reduced current being transmitted to said receivers and then said starter executing the low power mode and reducing the brightness of said warning lights; and E. whether the common control bus of said starter and said receivers having received a change ID command, if yes, going to step A; if no, continuing to execute said low power mode.

2. The method of controlling warning lights to enter low power mode as claimed in claim 1, wherein said flash mode comprises the modes of synchronous, interlace, polling, recursive and said low power.

3. The method of controlling warning lights to enter low power mode as claimed in claim 1, wherein said warning lights each comprise a circuit board, and a plurality of light emitting diodes, at least one EEPROM and multiple metal pads for electrical connection of multiple signal lines arranged on said circuit board.

4. The method of controlling warning lights to enter low power mode as claimed in claim 1, wherein in Step C, before selecting said low power mode from said flash mode to flash the light, the said warning light set as said starter performs an EEPROM data initialization.

5. The method of controlling warning lights to enter low power mode as claimed in claim 1, wherein said receivers execute a self-flash mode first before executing light flashing.

6. The method of controlling warning lights to enter low power mode as claimed in claim 1, wherein in step D, before the said warning lights set as receivers receive any signal from said control bus and said data bus through the signal lines thereof, the said warning lights set as receivers flash according to the flash mode stored in the EEPROM.

7. The method of controlling warning lights to enter low power mode as claimed in claim 1, wherein in step D, the control circuit is equipped with two voltage divider resistors on a input side thereof, one of said voltage divider resistors being connected in parallel with a Zener diode, said Zener diode being connected in parallel with said active switch, said active switch being connected in series with said current-reducing resistor, said current-reducing resistor being electrically connected to a pin with a current adjustment function of an LED control IC, two pins of said LED control IC being electrically connected with an inductor, a Schottky diode with a low turn-on voltage, a resistor, and an input voltage, two pins of said LED control IC being connected to the ground side with complex bypass capacitors that are capable of reducing noise, the sensing pin of said LED control IC being electrically connected to said light device, said light device comprising said warning lights to form the control circuit that is capable of executing said low power mode.

8. The method of controlling warning lights to enter low power mode as claimed in claim 1, wherein in step D, said current-reducing resistor reduces the passing current to a predetermined ratio ranges from 50%-80% of the maximum current value.

9. The method of controlling warning lights to enter low power mode as claimed in claim 1, wherein in step E, before said starter and said receivers change the identities thereof, said receivers suspend the current flash mode and then execute the self-flash mode.

* * * * *